US006994493B2

(12) United States Patent
Jones

(10) Patent No.: US 6,994,493 B2
(45) Date of Patent: Feb. 7, 2006

(54) PILE DRIVING SYSTEM AND PILE FOR ENGAGEMENT WITH SAID SYSTEM

(75) Inventor: Clive Jones, Blandford Forum (GB)

(73) Assignee: Fast Frames (UK) Limited, Dorchester (GB)

( * ) Notice: Subject to any disclaimer, the term of this patent is extended or adjusted under 35 U.S.C. 154(b) by 0 days.

(21) Appl. No.: 10/505,930

(22) PCT Filed: Feb. 5, 2003

(86) PCT No.: PCT/GB03/00493

§ 371 (c)(1),
(2), (4) Date: Feb. 8, 2005

(87) PCT Pub. No.: WO03/074795

PCT Pub. Date: Sep. 12, 2003

(65) Prior Publication Data

US 2005/0117976 A1 Jun. 2, 2005

(30) Foreign Application Priority Data

Mar. 4, 2002 (GB) ..... 0204987

(51) Int. Cl.
*E02D 7/00* (2006.01)

(52) U.S. Cl. ..... 405/232; 405/231; 405/228; 405/227

(58) Field of Classification Search ..... 405/227, 405/228, 231, 232, 195.1, 224
See application file for complete search history.

(56) References Cited

U.S. PATENT DOCUMENTS

| | | | | |
|---|---|---|---|---|
| 4,102,147 | A * | 7/1978 | Jansz | 405/228 |
| 4,509,883 | A | 4/1985 | Thibodeaux et al. | |
| 4,932,811 | A * | 6/1990 | Folding | 405/227 |
| 4,966,496 | A * | 10/1990 | Stelzer, Jr. | 405/227 |
| 5,332,047 | A | 7/1994 | Hignite | |
| 6,354,767 | B1 * | 3/2002 | Jones | 405/232 |
| 6,749,371 | B2 * | 6/2004 | Jones | 405/232 |

FOREIGN PATENT DOCUMENTS

| | | |
|---|---|---|
| EP | 0897034 A1 | 2/1999 |
| JP | 59-199914 | 11/1984 |
| JP | 07-292670 | 11/1995 |

* cited by examiner

*Primary Examiner*—Frederick L. Lagman
(74) *Attorney, Agent, or Firm*—Sheridan Ross P.C.

(57) ABSTRACT

A system for controlling pile orientation comprises a pile (14) and a pile guide (20) for supporting the pile as it is driven into a substrate, the pile guide comprising a base frame (10) and a pile guide member (22) mounted on the base frame. The pile (14) and the pile guide member (22) have slidaby interengaging profiles (30, 40) comprising first and second parts (32, 42), which are configured to axially rotate the pile to correct any misorientation relative to the pile guide as the parts slide past each other, and third and fourth parts (34, 44), which are configured to maintain a predetermined orientation of the pile relative to the pile guide once any misorientation has been corrected by interengagement of the first and second parts.

16 Claims, 3 Drawing Sheets

PILE DRIVING SYSTEM AND PILE FOR ENGAGEMENT WITH SAID SYSTEM

BACKGROUND OF THE INVENTION

1. Field of the Invention

The invention relates to pile driving, and more particularly, but not exclusively, to underwater pile driving, e.g. for stabbing piles directly into the seabed.

2. Description of the Background Art

It is known to provide a guide for aligning a pile with the surface of a substrate into which the pile is to be driven and to provide stability for a piling hammer. Particularly when piling underwater there is the problem that after the pile has been introduced into the seabed or the like, the guide must be removed to allow the pile to be driven into its final position. This guide removal is time consuming and thus expensive. Accordingly, the present applicant proposed in International patent publication WO99/11872 a pile guide which allows pile driving to continue from start to finish without any need to interrupt driving to remove the guide.

The pile driving apparatus described in WO99/11872 comprises a pile guide member which is supported on a base frame, a plan view of which is reproduced in FIG. 1. The base frame (10) has a substantially rectangular footprint (made up of a welded framework of girders and mudmats) with a centrally-placed aperture (12) through which a pile (14) is guided. The base frame 10 thus surrounds the pile (14). It will be seen however, that the base frame is formed with an aperture or slot (16) extending through the frame from its exterior to the central aperture (12) and through which a tether or rigging (18) fixed to the pile (14) can be passed.

In practice, it is important to orientate the pile so that the tether/rigging (18) will be aligned in a predetermined direction according to the intended use of the pile (14). Until now, a set pile orientation has been achieved using so-called orientation plates on the piles which engage a guide plate system in the pile guide member of the pile guide. The orientation plates are positioned on the piles in a known orientation relative to the tether/riggings couplings provided on the piles. In use, the orientation plates will engage the guide plate system as each mis-orientated pile is introduced into the pile guide member. The guide plate system forces the orientation plates to follow a helical path as the pile is further lowered through the pile guide member, causing the pile to rotate about its axis until the desired orientation relative to the base frame is achieved.

The present applicant has appreciated that more precise control of the orientation of piles being driven into a substrate (e.g. seabed) may be desirable, particularly in high swell conditions producing heave situations.

In accordance with a first aspect of the present invention, there is provided a system for controlling pile orientation comprising: a pile; and a pile guide for supporting the pile as it is driven into the substrate, comprising a base frame and a pile guide member mounted on the base frame, the pile and pile guide member having slidably interengagable profiles comprising first and second parts which are configured to axially rotate the pile to correct any mis-orientation relative to the pile guide as the parts slide past each other; characterised in that the interengaging profiles further comprise third and fourth parts which are configured to maintain a predetermined orientation of the pile relative to the pile guide once any mis-orientation has been corrected by interengagement of the first and second parts.

The third and fourth parts prevent the orientation of the pile from changing after the first and second parts have cleared each other as the pile is driven into the substrate. The third and fourth parts may be configured to engage each other before the first and second parts slide past and disengage each other. In this way, there is no risk that the predetermined orientation of the pile will not be maintained when the first and second parts disengage. This may be particularly important in heave situations which may produce periodic upward movements in the pile relative to the pile guide. In the conventional arrangement, once the first and second parts have slid past one another, any new mis-orientation in the pile may cause the first and second parts to jam against each other during heave-induced, relative upward movement.

The interengagable profiles (e.g. second and fourth parts) on the pile guide may be contiguous or may be spaced apart. The interengagable profiles (e.g. first and third parts) on the pile are spaced apart along the length of the pile.

The third and fourth parts may comprise a plate-like member and a channel in which the plate-like member is a sliding fit. The plate-like member may be mounted on the pile, and the channel may be provided on an inner periphery of the pile guide member.

The channel may have an upper flared opening for first receiving the plate-like member as the pile is lowered through the pile guide. The channel may also have a lower flared opening for re-engaging the plate-like member if the pile rises up through the pile guide (e.g. during heave situation).

The channel may be formed between a pair of spacer plates, the spacer plates being configured to centre the pile in the pile guide member.

The first and second parts may comprise an orientation plate and a guide plate system defining a helical pathway for the orientation plate. The orientation plate may be mounted on the pile, and the guide plate system may be provided on an inner periphery of the pile guide member. The guide plate system may define a pair of helical pathways of opposite senses of rotation, which define a tapering channel therebetween for correcting any mis-orientation in the pile. The tapering channel may have a flared portion at its lower end for re-capturing the orientation plate should the pile move upwards relative to the pile guide after the first and second parts have slid past each other.

In another aspect of the present invention, there is provided a pile for driving into a substrate, the pile comprising: an elongate body with a leading end and a trailing end; a coupling for receiving a tether, the coupling being located towards the trailing end; a first member projecting radially outwardly from the body, the first member being located towards the leading end; and a second member projecting radially outwardly from the body, the second member being axially spaced towards the trailing end from the first member.

The coupling may be angularly offset (e.g. 90°) relative to at least one member. The first and second members may be angularly aligned. The first member and/or the second member may be plate-like with the plane of the or each member parallel to the longitudinal axis of the body.

BRIEF DESCRIPTION OF THE DRAWINGS

An embodiment of the invention will now be described by way of example with reference to the accompanying drawings, in which.

DESCRIPTION OF SPECIFIC EMBODIMENT

Figure 1:
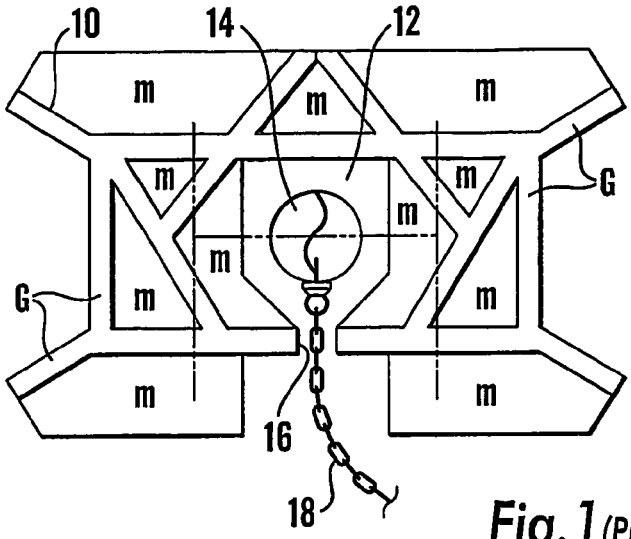
Fig. 1 (Prior Art)
FIG. 1 is a plane view of a prior art base frame.
Figure 2:
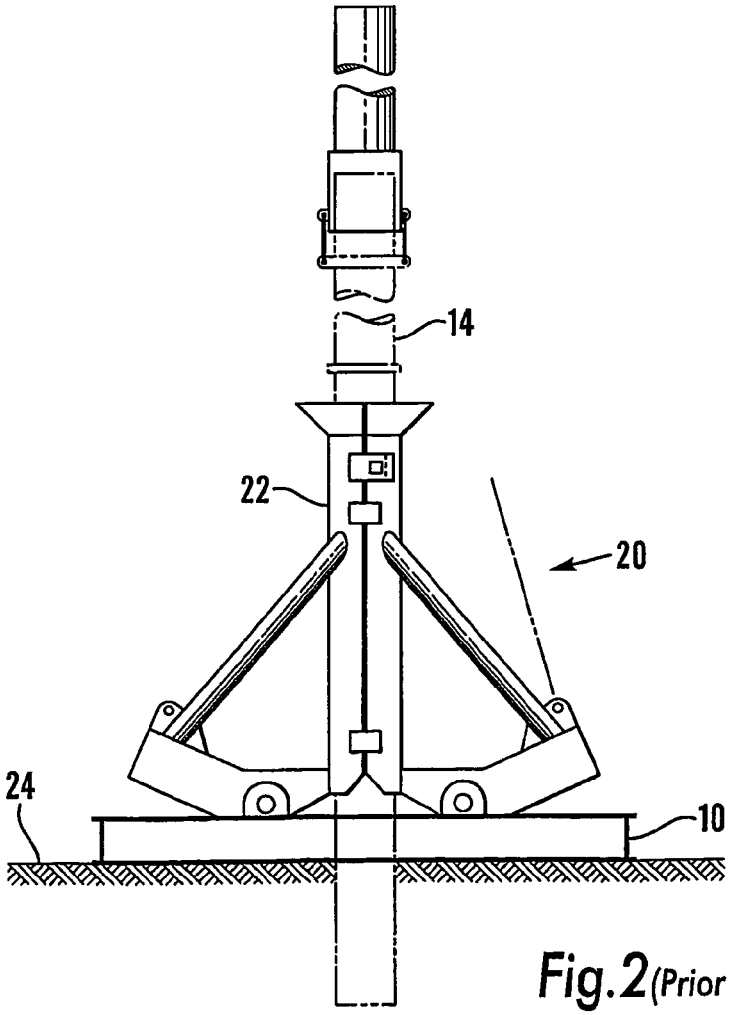
Fig. 2 (Prior Art)
FIG. 2 is a side view of a prior art pile guide for underwater pile driving.
Figure 3:
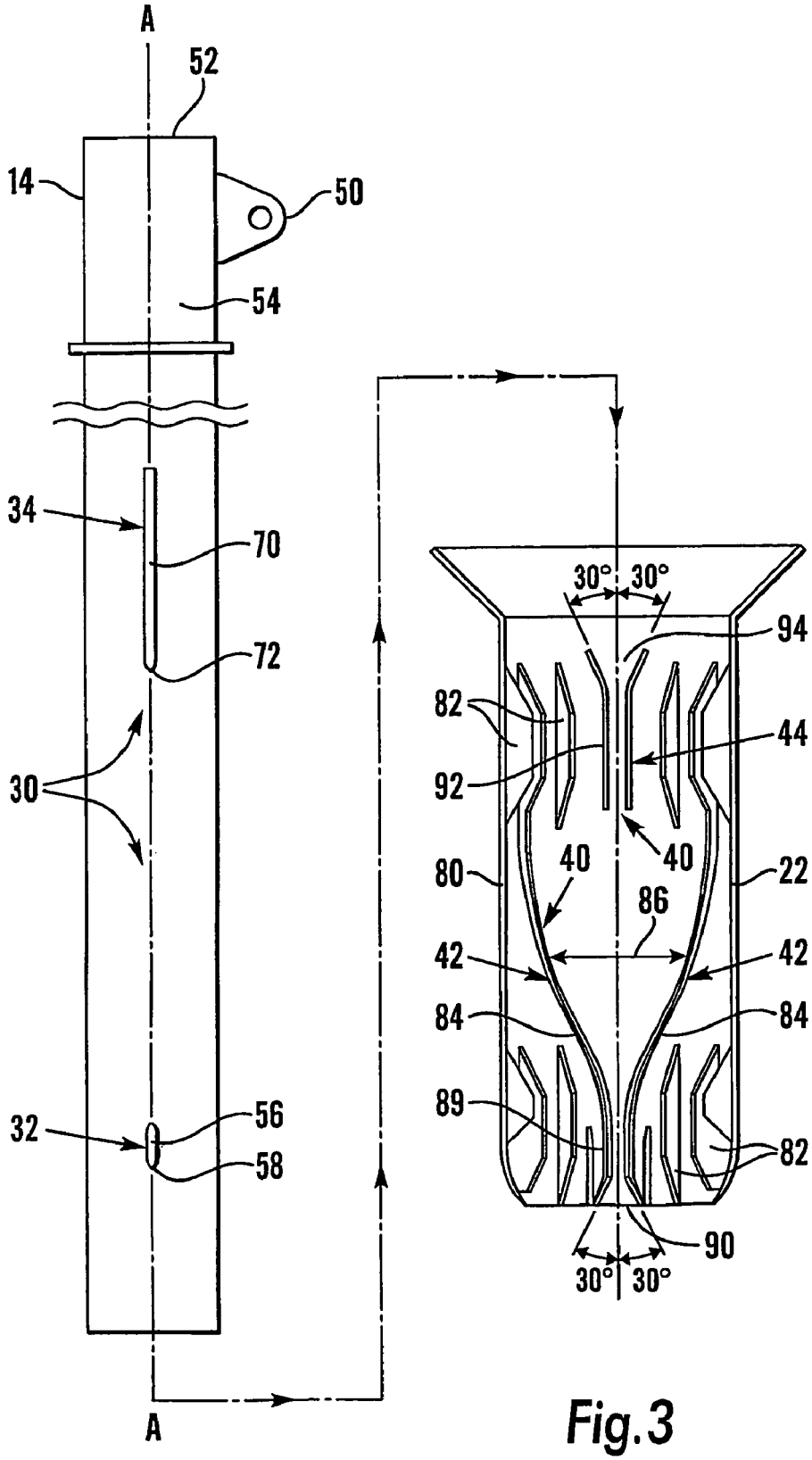
FIG. 3 is an exploded view showing a pile (from one side) and pile guide member (in vertical section) of a system embodying the present invention.
Figure 4:
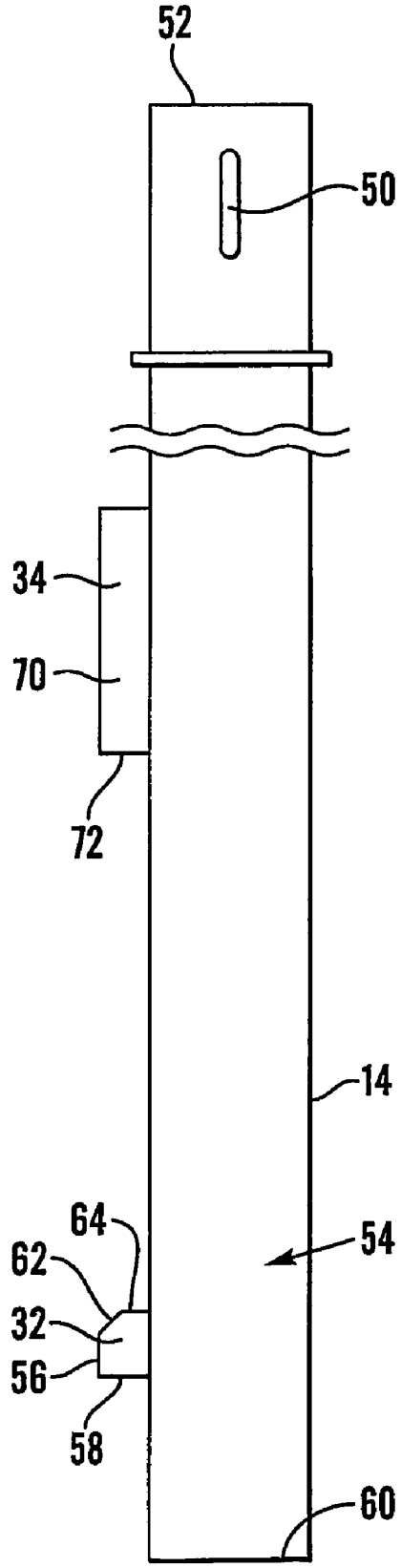
FIG. 4 is a view showing the pile of FIG. 3 from another side.

FIG. 2 shows a pile guide (20), known from WO99/11872, which comprises a base frame (10) (as per FIG. 1) and a pile guide member (22) mounted on the base frame (10). A pile (14) (as per FIG. 1) is supported by the pile guide member (22) whilst being driven into the substrate (24) (e.g. seabed).

The pile (14) and the pile guide member (22) have respectively interengaging profiles (30,40) different parts of which either correct any mis-orientation in the pile (14) relative to the pile guide (20) or maintain a predetermined orientation between the pile (14) and pile guide (20). Specifically, the interengaging profiles (30,40) include a first part (32) on pile (14) which engages a second part (42) on the inner periphery of pile guide member (22). Furthermore, the interengaging profiles (30,40) include a third part (34), located rearwardly of the first part (32) on pile (14), and a fourth part (44) on the inner periphery of the pile guide member (22). In use, the first part (32) engages the second part (42) as the pile (14) is lowered into the pile guide member (22). Any mis-orientation in the pile (14) is corrected as the first part (32) slides against the second part (42). As the correctly orientated pile (14) is further lowered, the third part (34) will engage the fourth part (44) to maintain the orientation of the pile (14) relative to the pile guide (20). The structure of the various parts (32,34) and (42,44) will now be considered in more detail.

The Pile (14)

The pile (14) includes a coupling (50) for a tether (not shown) which is located towards the trailing end (52) of the cylindrical body (54) of the pile (14). The first part (32) of the interengaging profile (30) comprises a primary orientation plate (56) which is aligned parallel to the longitudinal axis AA of the pile (14) and which projects radially outwardly from the body (54). The orientation plate (56) has a curved leading edge (58) (closest to leading end (60) of the body (54)) and chamfer (62) on its trailing edge (64). The other part (34) of the interengaging profile (30) comprises a secondary orientation plate (70) which is aligned with, but spaced rearwardly of, the primary orientation plate (56). Again, the leading edge (72) of the orientation plate (70) is rounded. Both orientation plates (56,70) are angularly offset by 90° from the coupling (50).

The Pile Guide Member (22)

The pile guide member (22) has a generally cylindrical housing (80) which includes a plurality of spacers (82) for centering the pile (14) in the pile guide member (22). One part (42) of the interengaging profile (40) includes a pair of helical guide plates (84) of opposite senses of rotation which define a tapering channel (86) for correcting any mis-orientation of the pile (14). The tapering channel (86) tapers to a neck region (89) which is flared at its lower end (90). The other part of (44) the interengaging profile (40) includes a pair of parallel guide plates (92) with a flared opening (94) at its upper end (96). The guide plates (92) have a spacing function just like spacers (82).

In use, the primary orientation plate (56) engages on the helical guide plates (84) as a mis-orientated pile (14) is lowered into the pile guide member (22). The primary orientation plate (56) slides against the engaged helical guide plate (84), causing the pile (14) to rotate into a predetermined orientation as it is further lowered. Before the primary orientation plate (56) exits the channel (86) through the neck region (89), the secondary orientation plate (70) slides between the parallel guide plates (92), maintaining the predetermined orientation of the pile (14).

What is claimed is:

1. A system for controlling pile orientation comprising: a pile; and a pile guide for supporting the pile as it is driven into a substrate, comprising a base frame and a pile guide member mounted on the base frame, the pile and pile guide member having slidably interengagable profiles comprising first and second parts which are configured to axially rotate the pile to correct any mis-orientation relative to the pile guide as the parts slide past each other; characterized in that the interengaging profiles further comprise third and fourth parts which are configured to maintain a predetermined orientation of the pile relative to the pile guide once any mis-orientation has been corrected by interengagement of the first and second parts.

2. A system according to claim 1, in which the third and fourth parts are configured to engage each other before the first and second parts slide past and disengage each other.

3. A system according to claim 1, in which the third and fourth parts comprise a plate-like member and a channel in which the plate-like member is a sliding fit.

4. A system according to claim 3, in which the plate-like member is mounted on the pile, and the channel is provided on an inner periphery of the pile guide member.

5. A system according to claim 3, in which the channel has an upper flared opening for first receiving the plate-like member as the pile is lowered through the pile guide.

6. A system according to claim 1, in which the channel further comprises a lower flared opening for re-engaging the plate-like member if the pile rises up through the pile guide.

7. A system according to claim 3, in which the channel is formed between a pair of spacer plates, the spacer plates being configured to center the pile in the pile guide member.

8. A system according to claim 1, in which the first and second parts comprise an orientation plate and a guide plate system defining a helical pathway for the orientation plate.

9. A system according to claim 8, in which the orientation plate is mounted on the pile, and the guide plate system is provided on an inner periphery of the pile guide member.

10. A system according to claim 8, in which the guide plate system defines a pair of helical pathways of opposite senses of rotation, which define a tapering channel therebetween for correcting any mis-orientation in the pile.

11. A system according to claim 10, in which the tapering channel has a flared portion at its lower end for re-capturing the orientation plate should the pile move upwards relative to the pile guide after the first and second parts have slid past each other.

12. A pile for driving into a substrate, the pile comprising:

an elongate body with a leading end and a trailing end;

a coupling for receiving a tether, the coupling being located towards the trailing end;

a first member projecting radially outwardly from the body, the first member being located towards the leading end; and a second member projecting radially outwardly from the body, with the second member being axially spaced towards the trailing end from the first member, and with the first and second members being configured to engage a pile guide and to orientate the pile in dependence on engagement with the pile guide.

13. A pile according to claim 12, in which the coupling is angularly offset relative to at least one member.

14. A pile according to claim 12, in which the first and second members are angularly aligned.

15. A pile according to claim 12, in which the first member is plate-like and defines a plane with the plane of the first member being parallel to a longitudinal axis of the body.

16. A pile according to claim 12, in which the second member is plate-like and defines a plane, with the plane of the second member being parallel to a longitudinal axis of the body.

* * * * *